US008366094B2

(12) United States Patent
Arnoux

(10) Patent No.: US 8,366,094 B2
(45) Date of Patent: Feb. 5, 2013

(54) METHOD OF PREPARING BATCHES OF MAIL

(75) Inventor: François Arnoux, Laon (FR)

(73) Assignees: Neopost Technologies, Bagneux (FR); Neopost Software & Integrated Solution, Ruti (CH)

( * ) Notice: Subject to any disclaimer, the term of this patent is extended or adjusted under 35 U.S.C. 154(b) by 0 days.

(21) Appl. No.: 13/288,421

(22) Filed: Nov. 3, 2011

(65) Prior Publication Data

US 2012/0110953 A1 May 10, 2012

(30) Foreign Application Priority Data

Nov. 8, 2010 (EP) ..... 10306229

(51) Int. Cl.
*B65H 33/04* (2006.01)

(52) U.S. Cl. ..... 270/58.06; 270/1.02; 270/52.02; 270/58.31; 270/58.32

(58) Field of Classification Search ..... 270/1.02, 270/52.02, 58.06, 58.31, 58.32
See application file for complete search history.

(56) References Cited

U.S. PATENT DOCUMENTS 5,366,212 A * 11/1994 Crowley et al. ..... 270/58.31
6,105,861 A * 8/2000 Kuit ..... 235/375
6,132,554 A 10/2000 Traise et al.
6,227,531 B1 * 5/2001 Guerrero et al. ..... 270/58.31
8,118,294 B2 * 2/2012 Skinger ..... 270/52.02

FOREIGN PATENT DOCUMENTS

EP 1832973 A2 9/2007
EP 2166512 A1 3/2010
WO 2008/005969 A2 1/2008

OTHER PUBLICATIONS

European Search Report for corresponding EP 10 30 6229 dated Feb. 28, 2011.

* cited by examiner

*Primary Examiner* — Leslie A Nicholson, III
(74) *Attorney, Agent, or Firm* — Sughrue Mion, PLLC

(57) ABSTRACT

A method of preparing batches of mailpieces using an envelope-stuffing machine. The method includes printing documents with each page bearing a first marking for causing the related document to be inserted into an envelope, and printing separator sheets each bearing a second marking for causing it to be folded into a predetermined particular geometrical shape; folding the documents and inserting them into empty envelopes having a common format; folding the separator sheets; and ejecting closed envelopes and the separator sheets folded into the predetermined particular geometrical shape. On being ejected by the envelope-stuffing machine, the separator sheets are interposed automatically between the closed envelopes as a function of the batches to be prepared, and the predetermined particular geometrical shape resulting in the separator sheets projecting from the predetermined common format of the envelopes.

8 Claims, 2 Drawing Sheets

METHOD OF PREPARING BATCHES OF MAIL

TECHNICAL FIELD

The present invention relates exclusively to the field of mail-handling and it relates more particularly to a method making it easier to put batches of mailpieces into boxes.

PRIOR ART

In order to obtain postal rates that are advantageous compared with rates for private individuals, companies take out bulk-mailing contracts, such as "Courrier Industriel" contracts in France, involving bringing franked or non-franked envelopes in batches to the premises of the postal authority in boxes (crates or cardboard boxes) and classified and grouped together in a very specific manner in order to be sent directly by the postal services to delivery centers without needing to break open the batches.

As a function of the contract signed with the postal authority, of the number of envelopes, and of the geographical distribution of the recipients of the envelopes, there can be more than a hundred batches to be placed in more than ten boxes.

Such a high number of batches raises serious organizational problems because it is essential to know where a batch starts and where it ends, in which box the batch should go and what the box contains. In addition, the order of the batches in a box may be very important for the logistics of the delivery center.

Currently, and as illustrated, for example, by Application EP 2 166 512, all of the documents to be inserted in envelopes are produced by one or more printers and are stored at the outlets of said printers once the printing has been performed. Then the operators take the batches coming from the printers and place them in the envelope-stuffing machine after removing the cover or separator pages that, in general separate the batches from one another and that, naturally, should not be inserted into the envelopes, the envelope-stuffing machine also being fed with empty envelopes. Since the separator sheet cannot mechanically follow the batch of documents to which it relates, it is necessary, once the envelope stuffing has been performed by the machine, to find the batch to which it belongs so as to enable the operator to make up batches of envelopes in the boxes allocated thereto, it being necessary for each box to be labeled with destination and content information relating only to the batches that it contains.

OBJECT AND DEFINITION OF THE INVENTION

An object of the invention is thus to mitigate the above-mentioned drawbacks with a method of preparing batches of mailpieces that facilitates the work of the operator while boxing the batches of envelopes.

These objects are achieved with a method of preparing batches of mailpieces using an envelope-stuffing machine, which method comprises the following steps:

printing a first plurality of documents on at least one printer, each page of said documents bearing a first specific marking for causing the document to which it relates to be inserted into an envelope;

printing a second plurality of separator sheets on at least one printer, each separator sheet bearing a second specific marking for causing it to be folded into a predetermined particular geometrical shape;

said envelope-stuffing machine reading said first specific marking;

in compliance with said first specific marking, said envelope-stuffing machine folding said first plurality of documents and inserting them into a first plurality of empty envelopes having a predetermined common format;

said envelope-stuffing machine reading said second specific marking;

in compliance with said second specific marking, said envelope-stuffing machine folding said second plurality of separator sheets into said predetermined particular geometrical shape; and ejecting closed envelopes containing said first plurality of documents and ejecting said second plurality of separator sheets folded into said predetermined particular geometrical shape, into an outlet bin of said envelope-stuffing machine;

said steps of folding said second plurality of separator sheets and of folding and inserting said first plurality of documents being performed in such a manner that, on being ejected by said envelope-stuffing machine, said separator sheets are interposed automatically between said closed envelopes as a function of batches to be prepared, and said predetermined particular geometrical shape resulting in said separator sheets projecting from said predetermined common format of said envelopes.

Thus, by making it possible to find the separator sheets automatically at the outlet of the envelope-stuffing machine at the exact location where each batch of envelopes starts, the operator no longer has to make up the batches again manually, and boxing is immediate and free of allocation errors.

Advantageously, said separator sheet may be a color sheet of A4 format, or a self-adhesive sheet of paper of A4 format.

Preferably, said separator sheet bears information relating to the destination and to the contents of the batch that it separates, and said second specific marking is Bar Code Recognition (BCR) marking or Optical Mark Recognition (OMR) marking.

Advantageously, the operation of folding into a predetermined particular geometrical shape results in said separator sheet being folded asymmetrically.

The invention also provides an envelope-stuffing machine for implementing the above-defined method of preparing batches of mailpieces. The envelope-stuffing machine includes read means for reading said second specific marking borne on said separator sheets, and control means for causing said separator sheets to be folded into a predetermined particular geometrical shape resulting in said separator sheets projecting from a predetermined common format of said envelopes.

BRIEF DESCRIPTION OF THE DRAWINGS

The invention can be better understood from the following detailed description given with non-limiting illustrative examples, and with reference to the following figures, in which.

DETAILED DESCRIPTION OF EMBODIMENTS

Figure 1:
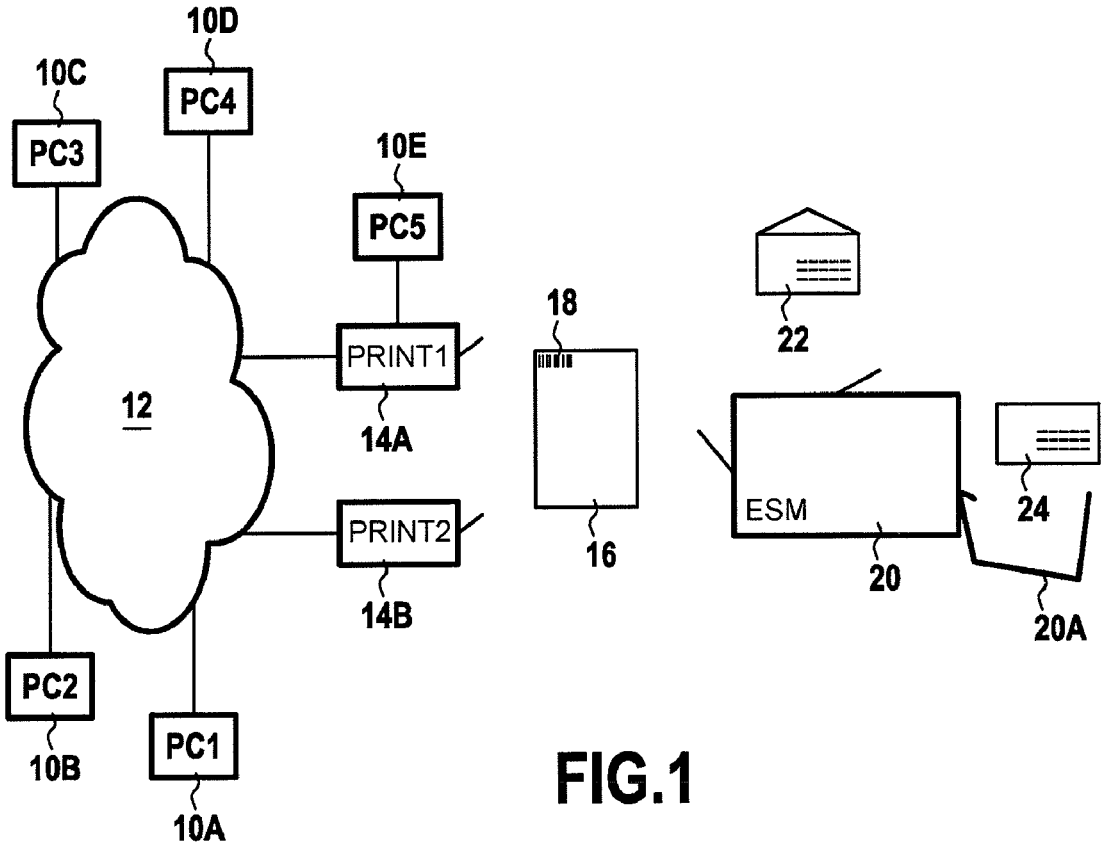
FIG. 1 is a view showing an example of a mail-handling system making it possible to implement the method of preparing batches of the invention.

FIG. 1 shows an example of a mail-handling system and more particularly the various modules making up the system and making it possible to prepare batches of mailpieces with a view to franking them or to sending them.

The documents are produced conventionally on computer terminals 10A to 10D that may or may not be connected to a corporate local area network (LAN) 12, and said documents are then printed out locally or remotely at one or more computer printers 14A, 14B. Each page 16 of said documents generally bears specific marking 18 of the BCR type or of the OMR type in order to enable them to be inserted as and when necessary into the envelopes that are to receive them. This insertion is performed at an envelope-stuffing machine 20 that receives firstly the various pages 16 and secondly empty envelopes 22 that may or may not be franked or indeed that may be provided with prepayment codes. At the outlet of this machine, stuffed envelopes 24 are then ejected into its outlet bin 20A.

Figure 2:
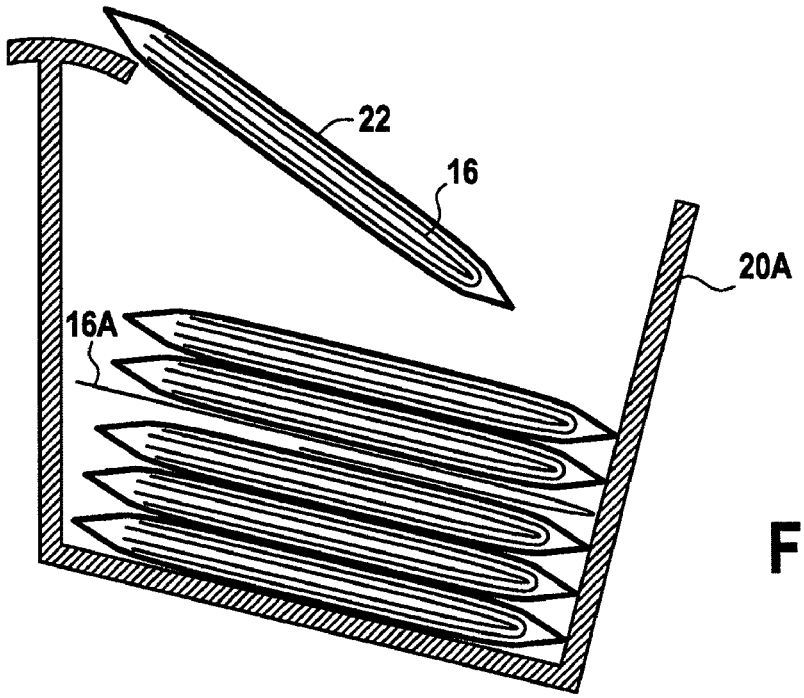
FIG. 2 is a view showing the contents of an outlet bin of the envelope-stuffing machine of the system of FIG. 1.

In accordance with the invention, and as shown more precisely in FIG. 2, separator sheets 16A designed to separate the various batches of envelopes and each bearing specific marking for enabling them to be processed by the envelope-stuffing machine like the pages of the documents. However, this marking does not cause the separator sheet to be inserted into the envelope, unlike for the other pages of the documents, but rather merely causes it to be folded into a predetermined particular geometrical shape and then to be ejected directly into the outlet bin 20A. Thus, whereas for a normal document page, the marking on the page causes it to be folded and to be inserted into an envelope, and causes the envelope to be ejected into the outlet bin, the marking on a separator sheet merely causes it to be folded and to be ejected into the same bin, envelope feeding being interrupted during these operations on the separator sheet.

In order to enable an operator to find the separator sheets immediately and thus to prepare the various batches rapidly, said sheets are preferably constituted by color sheets or by self-adhesive sheets, and, above all, the geometrical shape into which they are folded is such that they are readily identifiable. More particularly, the separator sheets are folded in a manner such that, once they have been folded, their size projects, by a predefined extra amount, from the size of the envelope. Thus, for an envelope of C5 format (229 millimeters (mm)×162 mm) inside which the documents of A4 format (210 mm×297 mm) that it contains, are folded symmetrically (folded in half), the separator sheet, which is itself of A4 format, is folded asymmetrically, e.g. two-thirds folded so as to generate an extra amount of size of one-sixth relative to the height of the envelope.

Figure 3:
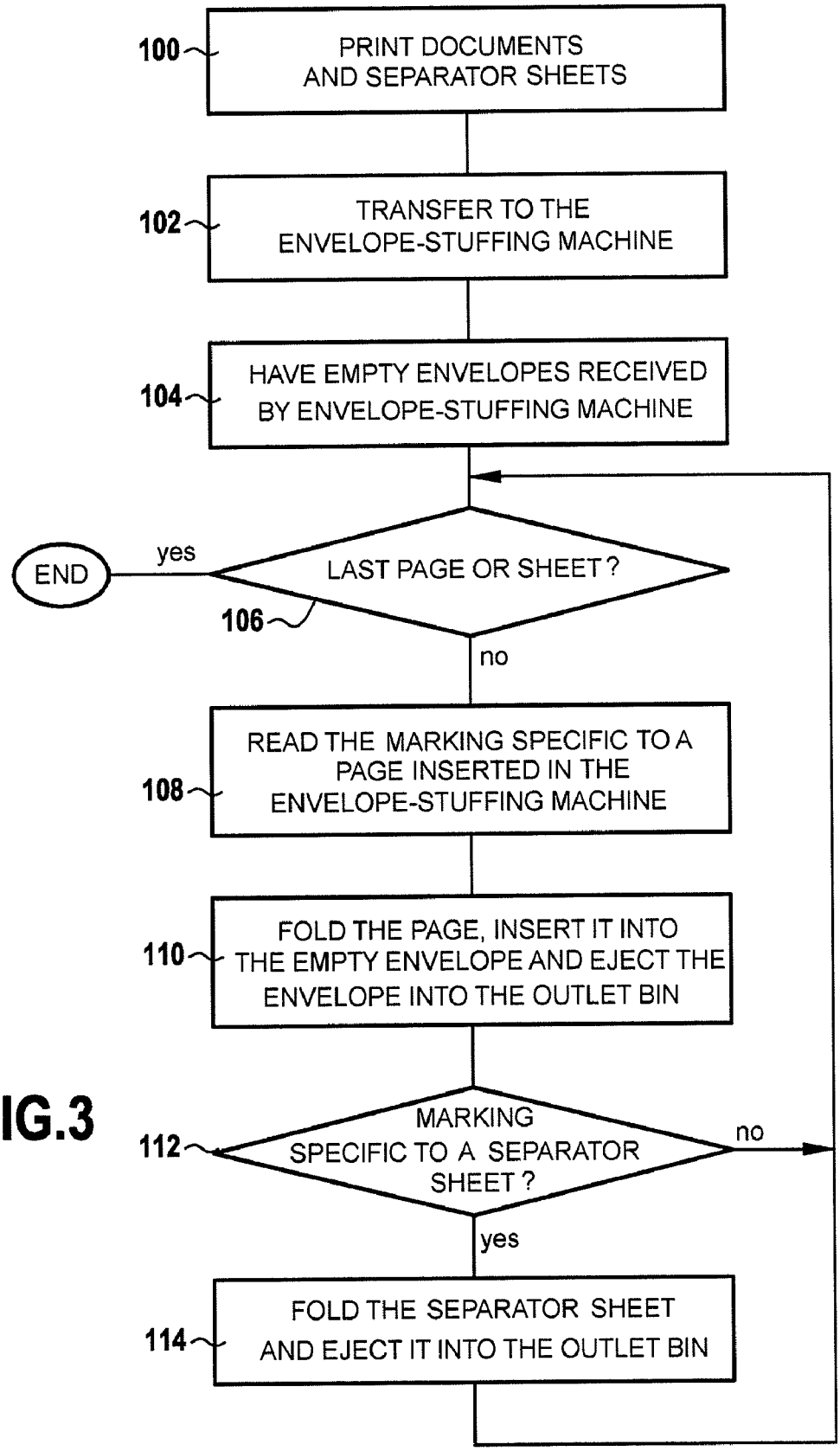
FIG. 3 is a flow chart giving details of the various steps of the method of preparing batches of the invention.

The various steps in the method of preparing batches of the invention are described below with reference to FIG. 3.

The first step 100 consists in printing the documents for the various batches to be prepared and the separator sheets for separating the batches. This printing can be performed on a single printer or on a plurality of printers, e.g. each printer printing a given batch. In a following step 102, the documents and separator sheets printed in this way are transferred to the envelope-stuffing machine manually or automatically if a mechanical link exists between the printer(s) and the machine. In parallel, in a step 104, the empty envelopes bearing the destination addresses are also transferred to the envelope-stuffing machine. Since the envelope-stuffing machine can then be fed both with documents and with envelopes, the documents can be processed automatically so long as there remain pages to process (answer to the test of step 106 "yes"). This processing starts in step 108 with reading of the specific marking borne by the first page inserted into the envelope-stuffing machine, this reading making it possible to cause the page to be folded, and to be inserted into the first envelope that is associated with it (optional reading of marking on the envelope during the insertion making it possible to check that the document and the envelope match), and then to cause the envelope to be ejected towards the outlet bin in a step 110. This processing is repeated until the marking on a separator sheet is read (test of step 112), this reading causing said sheet to be folded in the particular way, and causing it to be ejected to the outlet bin in a step 114, without it being inserted into any envelope prior to ejection. Then, the method returns to step 106 for processing the following pages, and so on until there are no more pages to be inserted (answer to the test of step 106 "no"). Naturally the steps 108 to 114 can take place the other way round (i.e. in the succession 112-114-108-110) when the first marking read is the marking on a separator sheet and not the marking on a document page.

The outlet bin then contains the closed envelopes disposed one after another, each batch of envelopes being separated by a separator sheet that is folded such that it is readily identifiable (in addition to any color or material used for it) due to its dimensions as folded that are slightly larger than the dimensions of the closed envelopes having the same common format. By means of this physical separation of the batches, it is then easy for the operator to box them with a view to sending them.

What is claimed is:

1. A method of preparing batches of mailpieces using an envelope-stuffing machine, which method comprises the following steps:

printing a first plurality of documents on at least one printer, each page of said documents bearing a first specific marking for causing the document to which it relates to be inserted into an envelope;

printing a second plurality of separator sheets on at least one printer, each separator sheet bearing a second specific marking for causing it to be folded into a predetermined particular geometrical shape;

said envelope-stuffing machine reading said first specific marking;

in compliance with said first specific marking, said envelope-stuffing machine folding said first plurality of documents and inserting them into a first plurality of empty envelopes having a predetermined common format;

said envelope-stuffing machine reading said second specific marking;

in compliance with said second specific marking, said envelope-stuffing machine folding said second plurality of separator sheets into said predetermined particular geometrical shape; and ejecting closed envelopes containing said first plurality of documents and ejecting said second plurality of separator sheets folded into said predetermined particular geometrical shape, into an outlet bin of said envelope-stuffing machine;

said steps of folding said second plurality of separator sheets and of folding and inserting said first plurality of documents being performed in such a manner that, on being ejected by said envelope-stuffing machine, said separator sheets are interposed automatically between said closed envelopes as a function of batches to be prepared, and said predetermined particular geometrical shape resulting in said separator sheets projecting from said predetermined common format of said envelopes.

2. A method according to claim 1, wherein said separator sheet is a color sheet of A4 format.

3. A method according to claim 2, wherein said separator sheet bears information relating to the destination and to the contents of the batch that it separates.

4. A method according to claim 2, wherein said second specific marking of said separator sheet is BCR marking or OMR marking.

5. A method according to claim 1, wherein said separator sheet is a self-adhesive sheet of paper of A4 format.

6. A method according to claim 1, wherein the operation of folding into a predetermined particular geometrical shape results in said separator sheet being folded asymmetrically.

7. An envelope-stuffing machine for implementing the method of preparing batches of mailpieces according to claim 1.

8. An envelope-stuffing machine according to claim 7, including read means for reading said second specific marking borne on said separator sheets, and control means for causing said separator sheets to be folded into a predetermined particular geometrical shape resulting in said separator sheets projecting from a predetermined common format of said envelopes.

* * * * *